United States Patent [19]

Schroeder

[11] 4,035,652

[45] July 12, 1977

[54] LUMINESCENT BACKING SHEET FOR WRITING IN THE DARK

[76] Inventor: Becky J. Schroeder, 2317 Valleybrook Drive, Toledo, Ohio 43615

[21] Appl. No.: 697,924

[22] Filed: June 21, 1976

Related U.S. Application Data

[63] Continuation of Ser. No. 567,391, April 11, 1975, which is a continuation-in-part of Ser. No. 498,705, Aug. 19, 1974, Pat. No. 3,879,611, which is a continuation-in-part of Ser. No. 428,339, Dec. 26, 1973, Pat. No. 3,832,556, which is a continuation of Ser. No. 288,148, Sept. 11, 1972, abandoned.

[51] Int. Cl.[2] ..... H01J 1/62

[52] U.S. Cl. ..... 250/462; 35/37; 250/486

[58] Field of Search ..... 250/462, 486; 35/36, 35/37, 38

[56] References Cited

U.S. PATENT DOCUMENTS

| | | | |
|---|---|---|---|
| 1,371,430 | 3/1921 | Nickerson | 35/38 |
| 2,341,583 | 2/1944 | Tuve | 250/462 X |

FOREIGN PATENT DOCUMENTS

| | | | |
|---|---|---|---|
| 559,603 | 2/1944 | United Kingdom | 250/462 |

*Primary Examiner*—Archie R. Borchelt
*Attorney, Agent, or Firm*—Charles F. Schroeder

[57] ABSTRACT

A lined phosphorescent backing sheet for use in underlying relation with writing paper or drawing sheets permitting a writer to write in orderly form in the dark without need for external light.

8 Claims, 6 Drawing Figures

LUMINESCENT BACKING SHEET FOR WRITING IN THE DARK

This is a continuation of application Ser. No. 567,391, filed Apr. 11, 1975, which is a continuation-in-part of application Ser. No. 498,705, filed Aug. 19, 1974, now U.S. Pat. 3,879,611, which was a continuation-in-part of application Ser. No. 428,339, filed Dec. 26, 1973, now U.S. Pat. 3,832,556, which was a continuation of my application Ser. No. 288,148, filed Sept. 11, 1972, now abandoned.

This invention relates to an auxiliary or backing sheet for use with writing paper to permit a writer to write legibly by hand in orderly straight line form in the dark.

If one attempts to write in the dark, I have found that although the mechanics of writing can be accomplished with little more than usual effort, writing in straight lines with uniform spacing between lines and without overlap is difficult in the absence of some guide means. According to my present invention I have found that guide lines for material written in the dark can be provided with very little light, and that as little light as is given off by a backing sheet having phosphorescent lines applied thereto is all that is necessary to enable one to write with a pencil or pen in orderly and neat form in the dark.

Furthermore, I have found that when a sheet, to which lines of commercially available phosphorescent paint is applied, is charged by even a brief exposure to light, may be seen clearly in the dark through one or more sheets of ordinary writing paper. For example, I have found that a one minute charge of light from an ordinary light bulb will provide visible phosphorescent lines which can be seen through ordinary writing paper in the dark for periods of 15 minutes or more.

In this regard, the invention becomes useful in laboratory work where observations are to be conducted in the dark. The invention can be used also in outer space travels where, as in recent travels of astronauts, the electrical systems of the spacecraft were required to be shut down for planned periods to permit recharging of equipment. Still further, the invention has practical value in writing in automobiles after dark without need for internal lighting which has a tendency to distract and disturb the driver.

In view of the foregoing it is an object of the present invention to provide means in the form of a luminescent backing sheet for writing paper which will provide visible guide lines in the dark, permitting a writer to write in straight lines without additional light.

In general according to my invention the backing sheet which is to be inserted under the writing paper can be provided with guide lines in two different forms. In one form, the lines can be provided by phosphorescent lines themselves, while in the other form the sheet is made phosphorescent with lines being non-phosphorescent.

A feature of the invention lies in its low cost and ease of use without need for special appliances.

Other objects and structural features which are believed to be characteristic of my invention are set forth with particularity in the appended claims. My invention, however, both in organization and manner of construction, together with further objects and features thereof may be best understood by reference to the following description taken in connection with the accompanying drawings in which:

Figure 1:
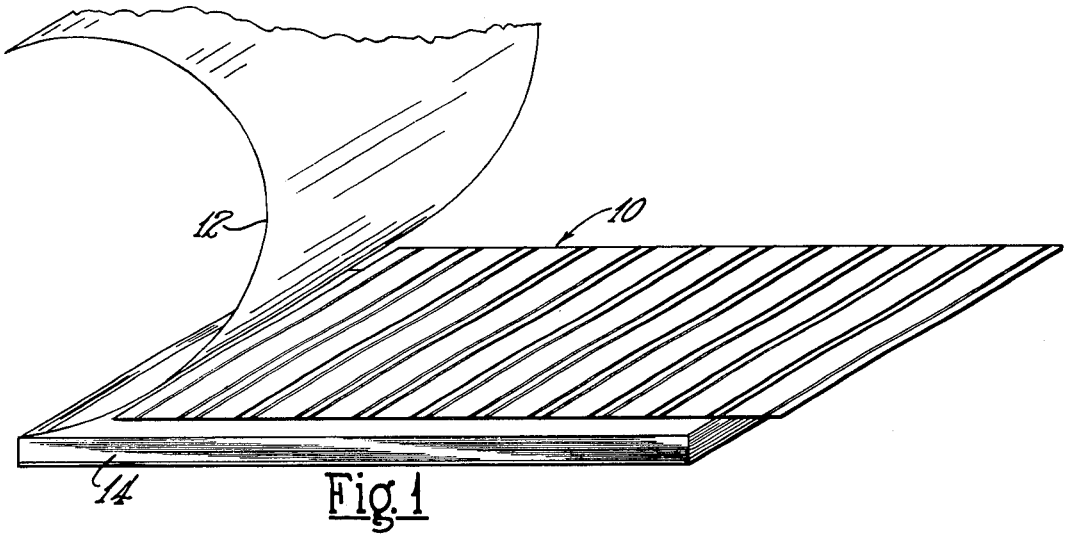
FIG. 1 is a perspective view of a writing tablet with a backing sheet of this invention in partially inserted position under the first paper sheet of the tablet.

Referring to the drawings in greater detail, FIG. 1 illustrates a tablet of writing paper 14 having a top sheet 12 lifted and turned back for insertion of a phosphorescent backing sheet 10 of my invention. As may be seen, the backing sheet can be provided with double lines or extra thick lines if desired.

Figure 2:
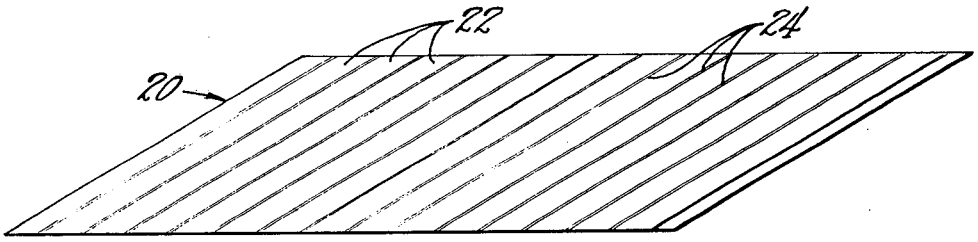
FIG. 2 is a perspective view of a phosphorescent backing sheet of this invention in which the guide lines are non-phosphorescent.

FIG. 2 illustrates a phosphorescent sheet 20 for use with the writing tablet 14 wherein the phosphorescent portions extend over the major portion of the sheet with lines 24 being non-phosphorescent. This sheet can be formed by applying phosphorescent matter in the form of paint or ink over the entire sheet with the non-phosphorescent lines being formed by the absence of phosphorescent material or by an overlay of non-phosphorescent material such as ink or narrow strips of tape, This embodiment is preferred form of the invention in that when viewed through the writing paper, written material above the lines is visible against the phosphorescent backing.

Whether or not the writing paper backed by the luminescent sheet of the present invention is lined or unlined, the guide lines enable orderly writing in the dark where ordinarily marked lines are ineffective. Where the writing paper is unlined, sharply marked dark lines on the backing sheet over a phosphorescent base provide guides for orderly handwriting both in the presence of light or in darkness.

Figure 3:
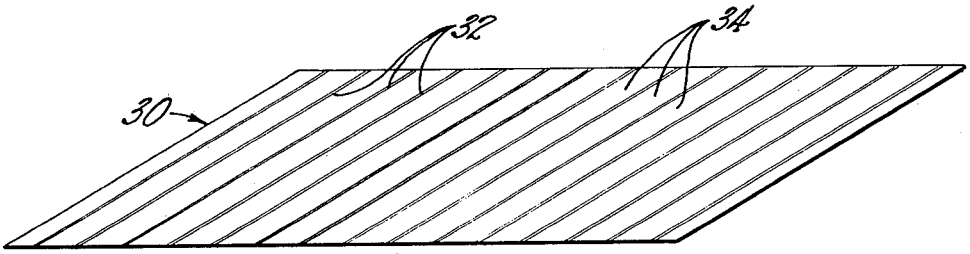
FIG. 3 is a perspective view of another embodiment of my invention in which the guide lines are of phosphorescent material.

FIG. 3 illustrates another embodiment of the invention wherein the backing sheet 30 is provided with parallel phosphorescent lines 32 while the in between portions 34 are non-phosphorescent. This form of the invention has the advantage of needing only a minimum phosphorescent material and is accordingly inexpensive.

Figure 4:
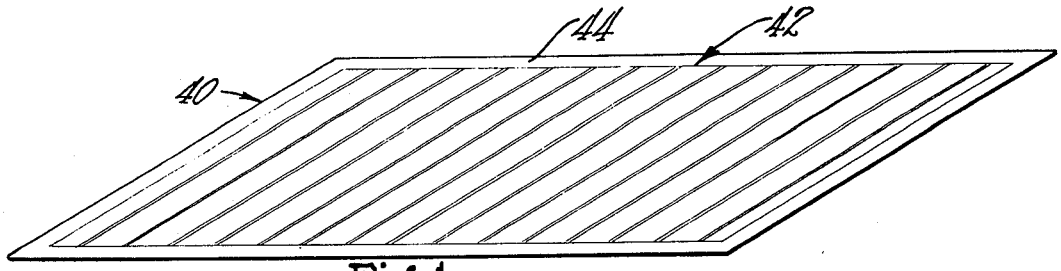
FIG. 4 is a perspective view of another form of my invention in which the phosphorescent portions are embodied in a plastic sheet.

While the phosphorescent backing sheets illustrated in FIGS. 1 to 3 may be any of a number of sheet materials such as ordinary paper, vellum, or even cloth, FIG. 4 is illustrative of a plastic sheet which may be phosphorescent material itself. It might be transluscent or transparent and thermoplastic, enabling encasement of non-phosphorescent line portions, embodied therein. It is preferably smooth and might be thicker and less flexible than writing paper itself to facilitate easier writing thereon for greater legibility. The horizontal and marginal lines for the written material might be black or a dark color and non-phosphorescent while the remaining portions of the sheet might be of phosphorescent plastic so that the backing sheet might be utilized either day or night for guidance of handwritten material when the writing paper is placed in overlying relation thereto. That is, by making the guide lines of the plastic sheet contrastingly visible through the writing paper, the sheet can be used for guide purposes under ordinary light as well as in darkness.

To activate the phosphorescent material as a guide for writing in the dark, it is exposed to a light for a period dependent upon intensity of the light. It is found that a period of only a moment is necessary to provide an adequate charge in ordinary incandescant light or daylight to provide adequate phosphorescence for writing a period of a quarter of an hour or more.

Figure 5:
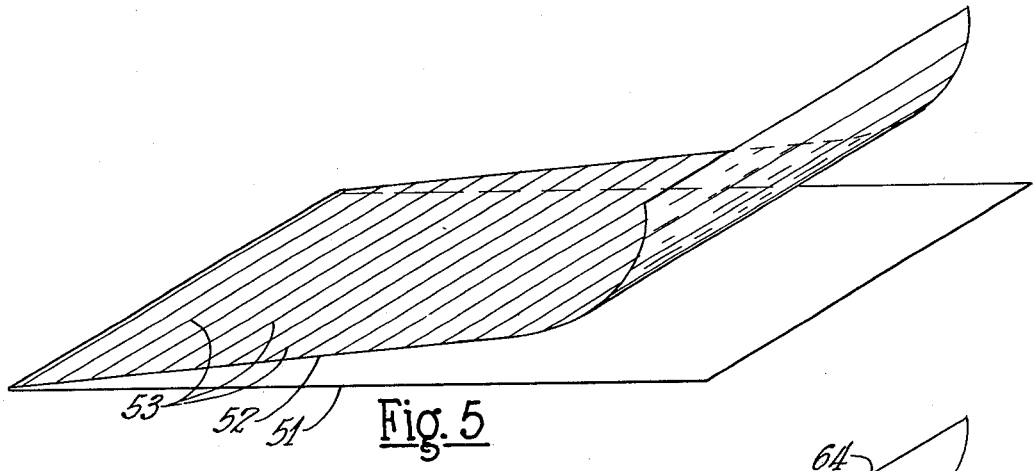
FIG. 5 is a perspective view of still another form of my invention in which guide lines are provided on a transparent sheet assembled with a phosphorescent surfaced backing sheet.
Figure 6:
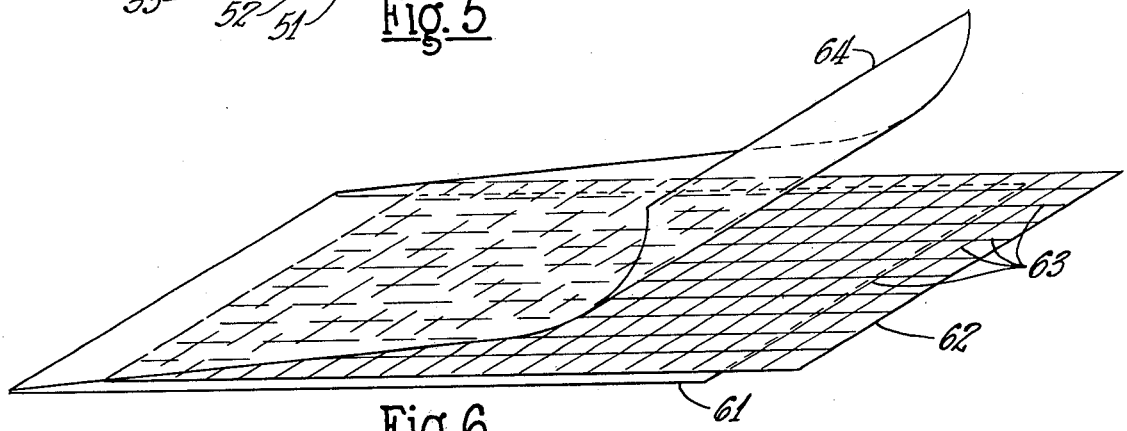
FIG. 6 is a perspective view of another assembly arrangement of my invention in which guide lines are provided on an overlay sheet interposed between a transparent top sheet and a phosphorescent surfaced member to which it is attached.

As still another form of the invention, a luminescent sheet 51 may be assembled as shown in FIG. 5 with a translucent or transparent overlay sheet 52 having relatively opaque guide lines 53 thereon. The assembly can be clipped, adhesively bonded or otherwise suitably secured together with the luminescent sheet, or as shown in FIG. 6 an overlay sheet 62 having guide lines 63 may be held in place between a translucent or transparent top sheet 64 such as of plastic suitably secured along one marginal or edge region of the luminescent sheet 61. This combination provides a flexibility in that the overlay sheet may be replaced with sheets having any number of guide line arrangements for combination with the phosphorescent sheet, while at the same time being readily placed under writing sheets for guiding application of matter thereto in the dark.

For example, vertical and horizontal guide lines or guide lines in the form of grids may be applied to the overlay sheet to permit application of intelligible matter in columns on writing paper in the dark. Still further, block sections of relatively opaque material might be provided on the overlay sheet to indicate preselected areas on writing paper or sheets which are not used while intelligible matter is applied to other areas in the dark. Figures or drawings might also be applied to the overlay sheet to provide guide lines for drawing pictures in the dark. In addition a number of games can be devised for playing in the dark and magic tricks can be devised based upon the performer's or audiences ability to observe material in the dark.

Still further, the underlying phosphorescent surface might be provided with non-phosphorescent regions which cooperate with the various opaque lines on the overlay sheet. The light passing overlay sheet can also be provided with phosphorescent guide lines or guide areas of luminescent material giving off light of different and contrasting color from the light given off by the underlying surface. Thus where a standard framework is desired for guiding the application of intelligible matter on writing or drawing sheets, a number of different opaque or luminescent guide line arrangements or grids can be cooperatively associated with the framework set out by the phosphorescent sheet to provide order to a series of sheets on which intelligible matter can be applied with the guide line combinations.

Where raised portions such as tape is used to set out the guide line arrangements, the raised regions it has been found can be readily felt through a writing sheet and can set as a guide in applying matter on a sheet.

In this regard, if the raised portions are luminescent they might be wide with narrow non-luminescent depressed or grooved regions between. The depressed regions in such an arrangement can act as feeler guides for application or written matter on the raised luminescent regions. If the raised luminescent portions are narrow with wide depressed regions between, the raised portions can act both as visible and physically feelable lines for application of intelligible matter to the dark between regions of overlying writing sheets.

If the raised portions are non-luminescent they are preferably narrow wth relatively wide depressed regions between for which the raised portions act as feelable guides through writing sheets for application of matter over the glow-through regions of the writing sheets. Under some conditions of use, however, a wide non-luminescent raised portion may be desired with narrow depressed luminescent regions between.

The spaced raised portions with omitted or cutout portions between can be unified into a single overlay sheet associated with and acting as part of the backing sheet assembly. The overlying sheet of the assembly can be transparent or opaque and may be integrated with the underlying base sheet of the assembly such as by thermoplastic or thermosetting adherence thereto.

Although the light emitting substance is referred to herein as "phosphorescent material", it will be understood that the invention may utilize any of a number of substances which will glow or emit light and accordingly the terminology phosphorescent material, as used herein is meant to include chemiluminescent and bioluminescent materials and any substance which will emit light without any apparent rise in temperature after exposure to a stimulus such as heat, light, or electric current, voltage, discharge and signals.

In view of the foregoing it will be understood that many variations of the arrangement of my invention can be provided within the broad scope of principles embodied therein. Thus, while particular preferred embodiments of my invention have been shown and described, it is intended by the appended claims to cover all such modifications which fall within the true spirit and scope of the invention.

I claim:

1. A backing sheet for guiding the application of written matter on writing sheets in darkness comprising:

a sheet having associated therewith a set of luminescent regions with a set of non-luminescent regions located therebetween which combination in the dark provides a guide for application of intelligible matter to writing sheets placed over the backing sheet, one of said sets of regions being raised above the other an amount sufficient to provide feeling guides spaced for application of written material therebetween which guides can be felt through writing sheets placed thereover in addition to providing visible guides in the dark for guiding the application of written matter on said writing sheets.

2. A backing sheet substantially as set forth in claim 1 wherein said raised regions are luminescent.

3. A backing sheet substantially as set forth in claim 1 wherein said raised regions are non-luminescent.

4. A backing sheet as set forth in claim 1 wherein said raised regions are parallel straight line regions.

5. A backing sheet as set forth in claim 4 wherein said raised regions are equispaced straight line regions.

6. A backing sheet substantially as set forth in claim 1 wherein said raised regions are in the form of tape strips adhered to the sheet.

7. A backing sheet as set forth in claim 1 wherein said raised regions are on an overlay sheet associated in assembly with said backing sheet.

8. A backing sheet as set forth in claim 7 wherein said overlay sheet is of material which will pass luminescent light therethrough.

* * * * *